United States Patent [19]

McMarlin

[11] Patent Number: 4,986,048

[45] Date of Patent: Jan. 22, 1991

[54] METHOD AND APPARATUS FOR ERECTING A GLASS BLOCK WALL

[75] Inventor: Robert M. McMarlin, Murraysville, Pa.

[73] Assignee: Pittsburgh Corning Corporation, Pittsburgh, Pa.

[21] Appl. No.: 463,386

[22] Filed: Jan. 11, 1990

[51] Int. Cl.[5] ..... E04B 5/46

[52] U.S. Cl. ..... 52/306; 52/308; 52/396

[58] Field of Search ..... 52/306, 307, 308, 396

[56] References Cited

U.S. PATENT DOCUMENTS

| | | | |
|---|---|---|---|
| 1,686,161 | 10/1928 | Liese | 52/307 |
| 2,216,220 | 10/1940 | Baker | 52/308 X |
| 2,239,537 | 4/1941 | Owen | 52/308 |
| 2,318,362 | 5/1943 | Boeglen et al. | 52/308 |
| 2,324,038 | 7/1943 | Steele | 52/306 X |
| 2,346,170 | 4/1944 | Kalkusch | 52/308 |
| 2,835,623 | 5/1958 | Vincent et al. | 52/308 X |
| 3,234,699 | 2/1966 | Smith | 52/308 X |
| 4,058,943 | 11/1977 | Sturgill | 52/307 X |
| 4,774,793 | 10/1988 | Mayer | 52/306 X |

OTHER PUBLICATIONS

PC Glass Block, Pittsburgh Corning Corporation, ©1988.

*Primary Examiner*—David A. Scherbel
*Assistant Examiner*—L. Watson
*Attorney, Agent, or Firm*—Stanley J. Price, Jr.

[57] ABSTRACT

A glass block wall has a frame member that frictionally engages the glass block adjacent thereto. A continuous flexible spacer member extends along the horizontal end walls of the glass blocks in each course. Separate vertical spacer members abut the adjacent vertical end walls of the glass blocks and a filler material is positioned in the recess formed between the edges of the adjacent glass blocks and the edge of the spacer member. The spacer members have a configuration to align the glass blocks in the wall and to stabilize each of the glass blocks in the wall.

12 Claims, 2 Drawing Sheets

METHOD AND APPARATUS FOR ERECTING A GLASS BLOCK WALL

BACKGROUND OF THE INVENTION

1. Field of the Invention

This invention relates to a method and apparatus for erecting a wall and more particularly to a method and apparatus for erecting a glass block wall within a frame member with spacer members positioned between the end walls of adjacent glass blocks.

2. Description of the Prior Art

Glass block walls have been erected in the past. The conventional method for erecting such walls include the use of mortar between the horizontal and vertical end walls much in the same manner as a conventional brick wall. Separate spacers have also been positioned between the horizontal end walls of the glass blocks.

As disclosed in U.S. Pat. Nos. 3,422,588 and 2,281,524 and French Patent No. 1,401,279, the end walls of the blocks have also been modified to provide mating surfaces with dove-tail type mortar receiving portions, other types of recessed portions and upwardly extending rail-like shoulder portions.

U.S. Pat. No. 4,058,943 discloses a glass block panel with a plurality of rigid interlocked spacers which form a grid-like structure surrounding the glass blocks.

U.S. Pat. No. 2,318,362 discloses a wall structure where the glass blocks have rib-like grooves in the end walls that are positioned on separator strips so that the wall structure may be disassembled without damaging the glass blocks.

U.S. Pat. No. 4,648,226 discloses a glass block with a modified configuration of the end walls. The modified glass blocks are arranged to be positioned in a frame having a mating configuration to maintain the glass blocks in a wall structure.

The Architectural Design Division of United Ceramic Tile, 156 Fifth Avenue, New York, N.Y. published a brochure that discloses the Tabiluz System which includes a frame and spacers fabricated from a rigid polyvinyl chloride. The joint appears to be a spacer having an elliptical configuration in section with inclined side walls that permit limited compression of the spacers. The spacers are wedged between the glass blocks during erection of the wall.

Steck Fix-Saverbat of Grandvillers, France published a brochure illustrating a frame having spaced vertical risers secured to the frame with the glass blocks positioned therebetween. Nylon spacers are positioned between the glass blocks to ensure evenness of the joints.

There is a need for a glass block wall that may be quickly assembled with a minimum of components and not require the modification of the shape of the end walls of conventional glass blocks.

SUMMARY OF THE INVENTION

In accordance with the invention, there is provided a block wall that includes a plurality of blocks that have a generally rectangular configuration with vertical and horizontal end walls and a pair of side walls. The side walls and the end walls form edge portions therebetween and the blocks have a preselected thickness between the side walls. A border member or frame has a body portion and a pair of longitudinal flanged edge portions that extend angularly therefrom. The flanged edge portions converge inwardly toward each other and are spaced from each other a dimension slightly less than the preselected thickness of the blocks. Certain of the blocks are arranged to be positioned with their side walls frictionally engaged between the border member or frame flanged edge portions. Spacer members are positioned between the adjacent vertical end walls and horizontal end walls of the blocks. The spacer members have a body portion and longitudinal edge portions. The spacer member has a lateral or transverse dimension smaller than the preselected thickness of the blocks to provide a channel-shaped recess between the adjacent block edge portions and the adjacent spacer longitudinal edge portion. A filler material is arranged to be positioned in this recessed portion to secure the blocks to each other and to the spacer member end portions.

The spacer member further includes rib portions extending along the longitudinal end portions. The rib portions have an upper shoulder portion with a horizontal flat surface and a lower shoulder portion with a horizontal flat surface. The ribs each have a vertical edge portion connected to the horizontal edge portions. The block edge portions are arranged to abut the horizontal flat surface of the rib portions to stabilize the adjacent blocks in the wall.

The spacer member may further include a pair of spaced intermediate rib portions extending upwardly and downwardly from the spacer member body portion. The intermediate rib portions extend longitudinally on the spacer member and form an upper recessed portion and a lower recessed portion that extends longitudinally on the spacer member. The raised continuous bead on the glass block is arranged to extend into the recessed portions to align and stabilize adjacent glass blocks in the wall.

A filler material such as a silicone caulking material is arranged to be positioned in the recessed portions between the block edge portions and the spacer member edge portion to further stabilize the glass block wall and maintain the adjacent glass blocks in position in the wall.

The invention further includes a method of fabricating a glass block wall which includes positioning a first glass block in a frame member corner portion and frictionally engaging said first glass block to said frame member. Forming a first course of glass blocks in the horizontal portion of the frame and frictionally engaging the first course of glass blocks to the horizontal portion of the frame. Spacer members are positioned between the vertical end walls of the glass blocks in the first course. The spacer members have a length substantially equal to the height of the glass block. An elongated horizontal spacer member is positioned over the horizontal top wall of the glass blocks in the first course. The horizontal spacer members are substantially in juxtaposition with the vertical spacers. A second course of glass blocks is formed in the wall by frictionally engaging a vertical edge of the first glass block in the second course to a vertical portion of the frame. All of the glass blocks in the second course are positioned on the horizontal spacer. Vertical spacers are positioned between the vertical end walls of the adjacent glass blocks. The steps of positioning the horizontal spacer, forming another course of glass blocks and positioning vertical spacers therebetween are repeated to form additional courses in the wall to complete the glass block wall. A filler material is applied in the recesses formed by the adjacent block edges and the edge of the spacers to further stabilize the glass block wall.

DESCRIPTION OF THE PREFERRED EMBODIMENTS

Figure 1:
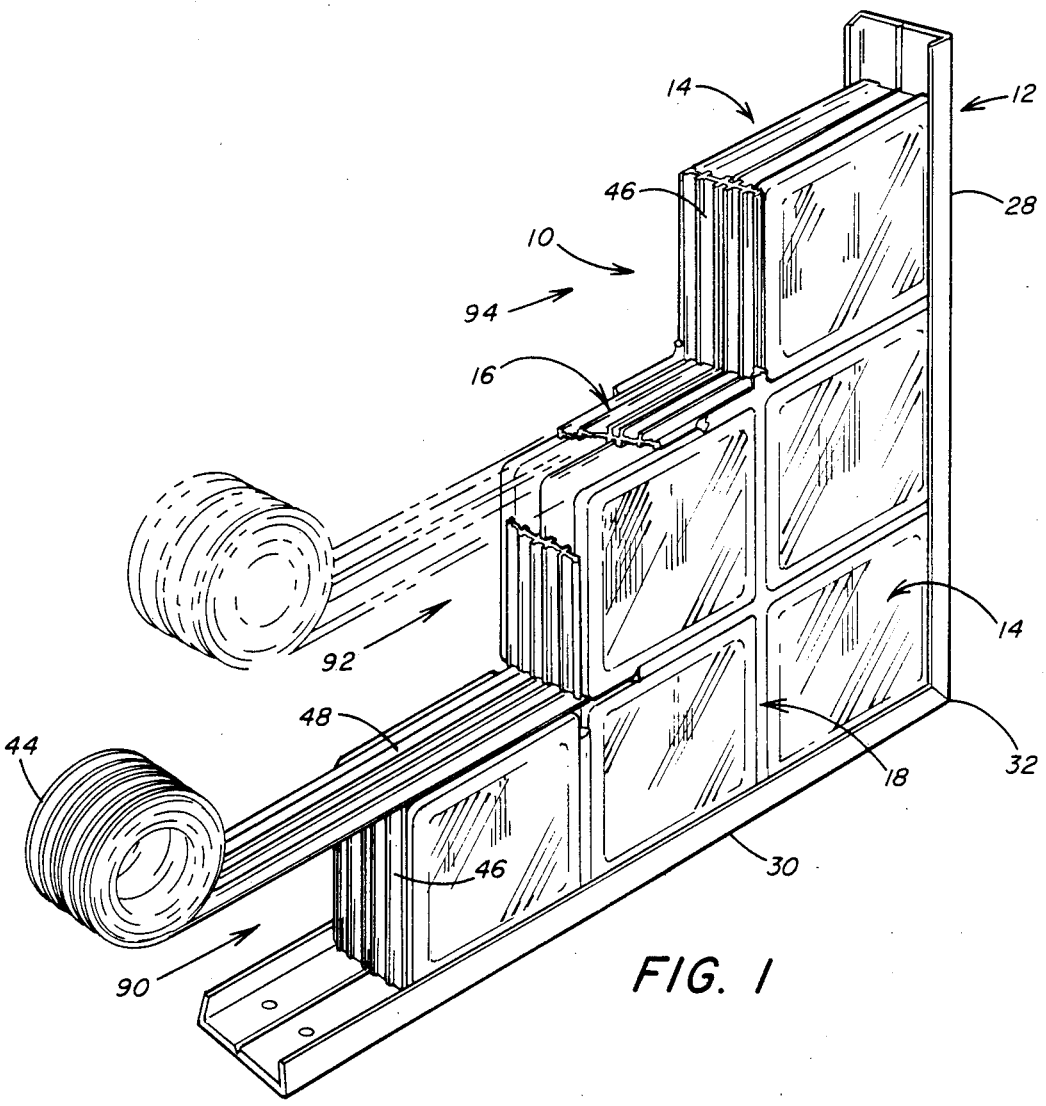
FIG. 1 is a fragmentary perspective view of a portion of a glass block wall.

Referring to FIG. 1, there is illustrated a glass block wall generally designated by the numeral 10 that includes a frame member 12, a plurality of glass blocks 14 with spacer members 16 positioned therebetween and a silicone caulking material 18 positioned in the joints between the glass blocks 14.

Figure 3:
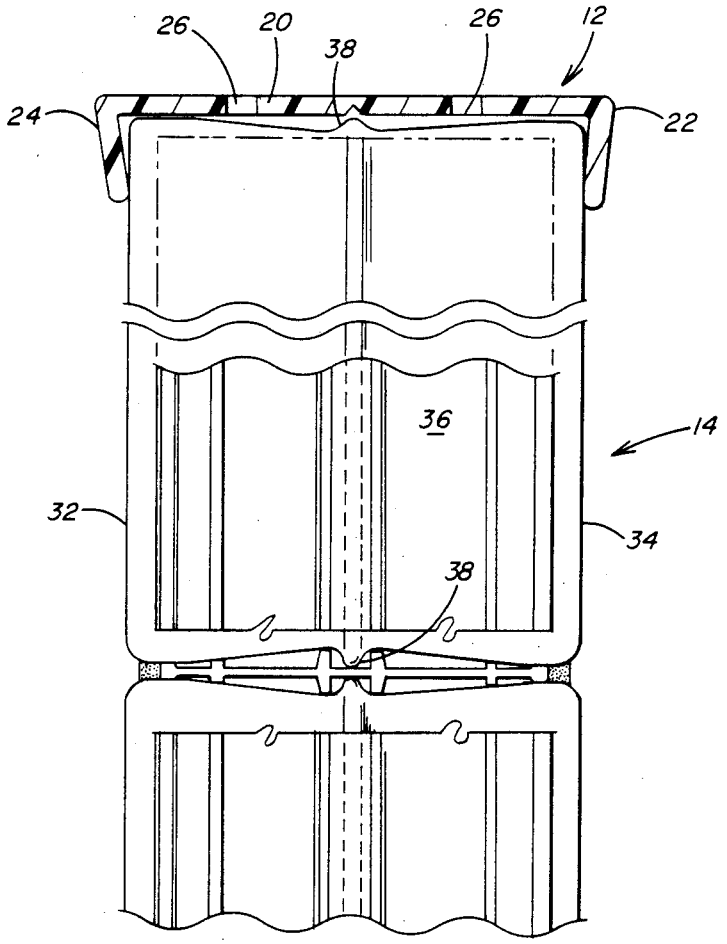
FIG. 3 is a top plan view illustrating the frame member and the horizontal spacer member broken away to illustrate a vertical spacer member and the silicone caulking.

The frame member 12 is preferably fabricated from a rigid polyvinyl chloride material although the frame member 12 may be fabricated from any other suitable material which provides a rigid frame for the glass blocks. As illustrated in FIG. 3, the frame member 12 has a body portion 20 and a pair of flanged end or edge portions 22 and 24. The flanged portions 22 and 24 are so dimensioned that they receive a glass block therebetween and are inwardly bent relative to the body portion 20 so that the blocks will snap into position within the frame 12 and be frictionally engaged therein. The glass block abuts the front edge of the body portion 20. Preferably, the frame 12 is made from a rigid polyvinyl chloride that will yield sufficiently to permit the glass blocks 14 to be snapped into place within the frame member and has sufficient rigidity for the flanges 22 and 24 to frictionally retain the glass block members therein and provide rigidity for the glass block wall 10.

The frame body member 20 has a plurality of apertures 26 therein arranged to receive wood screws or other fastening means to fasten the frame member 12 to a rigid adjoining structure. The frame member 12 fabricated from the channel-shaped plastic members has a vertical member 28 and a horizontal member 30 suitably joined to each other to form a corner 32. It should be understood that the frame member may also have another horizontal top member and another vertical member to form a generally rectangular frame. It should be understood, however, that the glass block wall may be fabricated with a portion of a frame that may be positioned in an appropriate opening within a structure.

Figure 2:
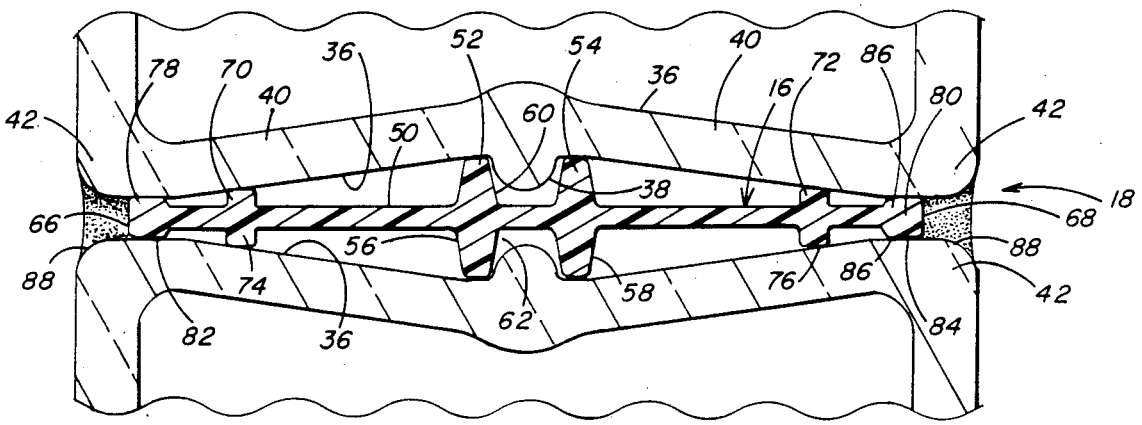
FIG. 2 is a view in section of a pair of glass blocks in the glass block wall illustrated in FIG. 1 with the spacer member positioned therebetween and the silicone caulking along the edges of the block.

The glass blocks 14 are conventional glass blocks having a generally rectangular configuration which are formed by fusing a pair of glass block halves to each other to form the hollow glass block. The glass blocks have a configuration as illustrated in FIGS. 2 and 3 with a pair of side walls or faces 32 and 34 with four peripheral vertical and horizontal end walls 36 which are joined to the side walls or faces 32 and 34. The glass block end walls 36 have the same configuration, however, in certain types of blocks which are rectangular with one dimension greater than the other, the area of the longer walls is greater than the area of the shorter vertical walls.

As previously discussed, the glass blocks are formed by a glass molding process where molten glass is poured into a mold and one-half of the block is formed in the mold. Thereafter two of the block halves are positioned with the free edges abutting each other and are subjected to heat to melt the glass along the edges and fuse the two block halves to each other to thus form a unitary, hollow glass block. The glass block end walls 36 have a raised portion or bead 38 which extends around the periphery of the block and is formed by the fused joint between the block halves. As illustrated in FIG. 2, the walls 36 have an inclined portion 40 and a rounded edge portion 42 with the edge portion 42 extending slightly below the raised portion 38.

The spacer member 16 positioned between the walls 38 of the glass blocks 14 is illustrated in detail in FIG. 2. The spacer member 16 is preferably fabricated from a suitable plastic material such as a flexible polyvinyl chloride having a 65 durometer hardness and is preferably fabricated from a translucent polyvinyl chloride material. It should be understood that other flexible materials having the desired rigidity to support the wall without substantial deformation may also be used. The spacer member 16 is fabricated in elongated lengths and may be stored in rolls 44 as illustrated in FIG. 1. The configuration of the spacer member 16 as later discussed is formed by extruding the polyvinyl chloride through an appropriate die to provide the desired configuration. Segments 46 of the spacer 16 which are positioned along the glass block vertical walls 36 are cut to a preselected length from the extruded spacer member 16 as that the segments 46 have a dimension where the edges of the spacer segment 46 will be in substantial juxtaposition with and preferably abut the continuous horizontal spacer 48. The intersection of the vertical spacer 46 and the continuous horizontal spacer 48 is illustrated in FIG. 1 along the first course of the glass blocks 14 in the glass block wall 10.

Referring to FIG. 2, the spacer 16 has a body portion 50 with a pair of intermediate rails 52 and 54 extending upwardly therefrom on opposite sides of the longitudinal axis of the spacer and a pair of downwardly extending rails 56 and 58 with the rails 52 and 54 being aligned with rails 56 and 58. A top channel or recess 60 is formed between the rails 52 and 54 and a bottom channel or recess 62 is formed between the rails 56 and 58. The spacer 16 is arranged to be positioned between the end walls 36 of adjacent glass blocks 14 with the raised portions 38 in the walls 36 extending downwardly into the respective channels 60 and 62. The channels 60 and 62 thus position the spacer member 16 relative to the glass block walls 36 by the glass block raised portions 38 extending into the respective channels and align the adjacent blocks relative to each other.

The spacer 16 has longitudinal edge portions 66 and 68 which have a rail-like configuration in section with a pair of upper and lower longitudinally extending ribs 70, 72, 74 and 76 respectively. The ribs 70–76 are arranged to abut the inclined surface 40 of the glass block walls 36 to provide further stability to the glass blocks as they are positioned in the wall 10. The ribs 70–76 are arranged to provide additional stability to that provided by the enlarged edge portions 66 and 68 of the spacer 16. The edge portions 66 and 68 have upper shoulder portions 78 and 80 and lower shoulder portions 82 and 84. The shoulder portions 78–84 all have flat surfaces 86 which are arranged to abut the adjacent wall of the glass block so that the glass block rests on the flat surfaces 86 to support and stabilize the glass blocks 14 when positioned in the wall 10. The ribs 70–76 spaced inwardly from the shoulders 78–84 are arranged to provide additional stability to the glass blocks 14 and in certain types of installations the intermediate ribs 70–76 may be omitted where the shoulders 78–84 provide adequate stability for the glass blocks 14 in the wall 10.

The vertical dimension between the flat surfaces 86 of shoulders 78 and 82 and 80 and 84 is preferably such that the spacing between the curved edges 42 of the glass block is approximately ⅛" and the width of the space is such that a space is provided between the edges of the glass block and the edges 66 and 68 of the spacer is about ⅛". With this arrangement there is a generally rectangular space 88 between the glass block curved edges 42 and the edges 66 and 68 of spacer 16 that has dimensions of about ⅛" by ⅛". Such a spacing provides a space for the translucent silicone caulking 18 which will cure and set and rigidify to further add rigidity to the glass block wall. Silicone caulking in large amounts does not rigidify throughout and thus does not provide a rigid filler material. With the dimensions of the space 88 provided between the glass block edges 42 and the spacer edges 66 and 68, the silicone caulking 18 will rigidify and provide additional stability to the glass block wall 10.

The glass block wall 10 is erected as illustrated in the preferred embodiment. The frame 10 is secured to an adjacent rigid structure by means of screws or the like extending through the apertures 26 into the adjacent structure. As illustrated in FIG. 1, the first course 90 of glass blocks 14 is positioned in the frame by wedging the glass blocks between the frame flanges 22 and 24. A segment of the spacer 16 referred to as the vertical spacer 46 is positioned between the vertical end walls 36 of the adjacent glass blocks so that the first course 90 includes the glass blocks 14 with the vertical spacers 46 therebetween. The end walls 36 of the glass blocks abut the vertical spacer 46 as previously described with the recessed portions 38 of each glass block extending into the adjacent channels 60 and 62 of the spacer 16 as illustrated in FIG. 3.

After the first course of blocks are positioned in the frame 10, as above described, a roll 44 of spacer material is positioned in abutting relation with the upper horizontal end walls 36 of the glass blocks 14 and extend the length of the first course. As previously described, the vertical spacers 46 are of such a length that they are in juxtaposition with the underside of the horizontal spacer 48. After the horizontal spacer 48 is positioned as illustrated in FIG. 2 on top of the first course of blocks 90, a first glass block of the second course 92 is secured in the vertical frame 12 and a vertical spacer 46 is positioned along the glass block exposed vertical end wall 36. Then a second glass block is positioned in overlying relation with the second glass block in the first course and is moved into abutting relation with the vertical spacer 46 between the first and second glass block. This procedure is continued alternating glass blocks 14 and vertical spacers 46 until the second course 92 is completed. Thereafter a horizontal spacer 48 is positioned on the upper surface of the second course of glass blocks by again unrolling the spacer from the spacer roll so that it extends along the entire length of the wall. The end of the continuous horizontal spacer 48 is formed by cutting the spacer from the roll 44 at the preselected length. It should be understood that the horizontal spacer 48 may be cut into any suitable lengths from the roll 44 before the wall is formed as long as the horizontal spacer extends along the length of a glass block. The second course 92 has the glass blocks 14 in abutting relation with the upper surface of the horizontal spacer 48 and vertical spacers 46 are positioned between the adjacent glass blocks.

The third course 94 is installed in a similar manner as are the remaining courses in the glass block wall 10. The first course 90 preferably has both end blocks 14 positioned in a vertical frame member 28 and the top course has the glass blocks positioned in an upper horizontal frame (not shown) 30. It should be understood that a unitary rectangular wall structure may be formed or preassembled with the respective vertical and horizontal frames 28 and 30 secured in position and the preassembled wall transported to a location for assembly as either a separate wall or installed in an existing opening.

After the wall structure is formed, a suitable translucent silicone caulking compound 18 is applied in the opening 88 and may be trimmed by a suitable trimming tool to form a smooth surface which will rigidify and provide an aesthetic appearance in addition to rigidifying the glass block wall.

Although the preferred embodiment discloses a wall formed from hollow glass blocks, it should be understood, it is within the scope of this invention to use blocks made from other materials such as plastic, for example an acrylic plastic and other suitable materials. It is also within the scope of the invention to use solid blocks or hollow blocks containing filler materials.

According to the provisions of the Patent Statutes, I have explained the principle, preferred construction and mode of operation of my invention and have illustrated and described what I now consider to represent its best embodiment. However, it should be understood, within the scope of the appended claims, the invention may be practiced otherwise than as specifically illustrated and described therein.

I claim:

1. A block wall comprising, a plurality of blocks having a generally rectangular configuration with vertical and horizontal end walls and a pair of side walls, said side walls and said end walls forming edge portions therebetween, said blocks having a preselected thickness between said side walls, a border member having a body portion and a pair of longitudinal flanged edge portions extending angularly therefrom, said flanged edge portions converging inwardly toward each other, said flanged edge portions spaced from each other a dimension slightly less than said preselected thickness of said blocks, certain of said blocks arranged to have said side walls frictionally engaged between said border member flanged edge portions, spacer members arranged to be positioned between said adjacent vertical end walls and horizontal end walls of said blocks, said spacer members having a body portion, longitudinal end portions and a transverse dimension smaller than said preselected thickness of said blocks to provide a channel shaped recessed portion between said adjacent block edge portions and said spacer longitudinal edge portion, and a filler material arranged to be positioned in said recessed portions to secure said blocks to each other and to said spacer member end portions.

2. A block wall as set forth in claim 1 in which, said spacer member includes rib portions extending along said longitudinal end portions, said ribs having an upper shoulder portion with a horizontal flat surface and a lower shoulder portion with a horizontal flat surface, said ribs each having a vertical edge portion connected to said horizontal surface portions, said block edge portions arranged to abut said horizontal flat surfaces of said rib portions to stabilize said adjacent blocks in said wall.

3. A block wall as set forth in claim 2 in which, said spacer member includes an intermediate rib portion extending longitudinally thereon, said intermediate rib portion arranged to further stabilize said adjacent blocks in said wall.

4. A glass block wall comprising, a plurality of glass blocks, said glass blocks each formed from a pair of hollow glass block halves with rectangular edge portions fused to each other and forming a raised continuous bead therebetween, said glass blocks having a generally rectangular configuration with vertical and horizontal end walls and a pair of side walls, said side walls and said end walls forming edge portions therebetween, said glass blocks having a preselected thickness between said side walls, said raised continuous bead formed in said vertical and horizontal end walls intermediate said edge portions, a frame member having a horizontal member and a vertical member secured thereto and extending angularly therefrom, said horizontal member and said vertical member each having a body portion and a pair of longitudinal flanged edge portions extending angularly therefrom, said flanged edge portions converging inwardly toward each other, said flanged edge portions having portions spaced from each other a dimension slightly less than said preselected thickness of said blocks, at least one of said blocks arranged to have said side walls frictionally engaged between said horizontal and vertical frame member flanged edge portions, certain of said blocks arranged to have said side walls frictionally engaged by said frame vertical member flanged edge portions and other of said blocks arranged to have said side walls frictionally engaged by said frame horizontal member flanged edge portions, spacer members arranged to be positioned between said adjacent glass block vertical end walls and horizontal end walls, said spacer members having a body portion with a pair of spaced intermediate rib portions extending longitudinally thereon, said rib portions forming an upper recessed portion and a lower recessed portion extending longitudinally on said spacer member, said raised continuous bead of said glass block arranged to extend into one of said recessed portions to align and stabilize adjacent glass blocks in said wall, and means abutting the edge portions of adjacent glass blocks to maintain said adjacent glass blocks in position in said wall.

5. A glass block wall as set forth in claim 4 in which, said spacer member including longitudinal edge portions and a transverse dimension smaller than said preselected dimension of said blocks to provide a channel-shaped recess portion between adjacent block edge portions and said adjacent spacer longitudinal edge portion, and said means abutting said adjacent glass block edge portions and said spacer longitudinal edge portion to maintain said adjacent blocks in position in said wall.

6. A glass block wall as set forth in claim 5 in which, said spacer member longitudinal edge portions include rib portions extending therealong, said rib portions having an upper shoulder portion with a horizontal flat surface and a lower shoulder portion with a horizontal flat surface, said adjacent block edge portions arranged to abut said horizontal flat surfaces of said rib portions to stabilize said adjacent blocks in said wall.

7. A glass block wall as set forth in claim 6 in which, said vertical and horizontal end walls of said glass blocks having inclined surface portions, said spacer member including a pair of second intermediate ribs, each second intermediate rib positioned between said longitudinal edge portion and said first intermediate rib portion, said second intermediate ribs arranged to abut said inclined surface of portions of adjacent end walls of adjacent glass blocks to further stabilize said glass blocks in said wall.

8. A glass block wall comprising, a plurality of glass blocks, said glass blocks each formed from a pair of hollow glass block halves with rectangular edge portions fused to each other and forming a raised continuous bead therebetween, said glass blocks having a generally rectangular configuration with vertical and horizontal end walls and a pair of side walls, said side walls and said end walls forming edge portions therebetween, said glass blocks having a preselected thickness between said side walls, said raised continuous bead formed in said vertical and horizontal end walls intermediate said edge portions, said glass blocks positioned in abutting relation to each other with spacer members positioned between adjacent horizontal walls and vertical walls of said glass blocks, said spacer members having a body portion with a pair of spaced intermediate rib portions extending longitudinally thereon, said spacer body portion having a width substantially equal to the preselected thickness between said side edges of said glass blocks said rib portions forming an upper recessed portion and a lower recessed portion extending longitudinally on said spacer member, said glass block raised continuous bead arranged to extend into one of said recessed portions to align and stabilize adjacent glass blocks in said wall, and portions of said spacer members abutting the edge portions of adjacent blocks to maintain said adjacent blocks in position and in spaced relation in said wall.

9. A glass block wall as set forth in claim 8 in which, said spacer members positioned between said adjacent vertical end walls of said glass blocks having the same configuration as said spacer members positioned between said horizontal wall of said glass block with a dimension substantially equal to the height of one of said glass blocks, said spacer members positioned between said horizontal walls of said glass blocks having a dimension greater than the length of a plurality of said glass blocks and extending over a plurality of glass blocks, said spacer members positioned between said vertical walls in juxtaposition with said adjacent upper and lower spacer members positioned between said horizontal walls.

10. A spacer member arranged to be positioned between a pair of glass blocks in a glass block wall comprising, an elongated body portion formed from a flexible plastic material having sufficient strength to resist deformation under load from said glass blocks in said wall, said body portion having a top surface, a bottom surface and side edge portions, said body portion top surface having a pair of spaced parallel longitudinal ribs extending upwardly therefrom intermediate said side edge portions and forming an upper recessed portion therebetween, said body portion bottom surface having a second pair of spaced parallel longitudinal ribs extending downwardly therefrom in underlying relation with said first pair of ribs and forming a lower recessed portion, said recessed portions both arranged to receive the beaded portion of a glass block to stabilize and position the glass blocks in the glass block wall, and said body portion top surface and said bottom surface having raised surface portions adjacent said edge portions, said raised surface portions arranged to support the edge portions of said glass blocks in spaced relation to each other.

11. A spacer member as set forth in claim 10 in which, said body portion includes a third pair of rib portions extending adjacent said side edge portions, said third pair of ribs each having a raised upper portion with a flat surface and a raised lower portion with a flat surface, said ribs each having a vertical edge connected to said body portion, said glass block end walls having a portion arranged to abut said rib portions to stabilize said adjacent glass blocks in said wall.

12. A method of fabricating a glass block wall comprising, (a) positioning a first glass block in a frame member corner portion and frictionally engaging said first glass block to said frame member, (b) forming a first course of glass blocks in the horizontal portion of the frame and frictionally engaging said first course to the horizontal portion of said frame, (c) positioning spacer members between the vertical end walls of the glass blocks in said first course, said vertical spacer members having a length substantially equal to the height of said glass blocks, (d) positioning an elongated horizontal spacer on the upper surface of said first course, said horizontal spacer positioned in substantially juxtaposition with said vertical spacers, (e) forming a second course of glass blocks by frictionally engaging a vertical edge of the first glass block in said second course to a vertical portion of said frame, (f) positioning all of said glass blocks in said second course on said horizontal spacer, (g) positioning vertical spacers between the vertical end walls of adjacent glass blocks, (h) said vertical spacer members having intermediate rib portions forming intermediate upper and lower recessed portions, (i) positioning the intermediate bead of adjacent glass block end walls in said recessed portions, (j) said horizontal spacer having the same configuration in section as said vertical spacers, (k) positioning the intermediate bead of adjacent glass blocks in said recessed portion of said horizontal spacer, (l) positioning all of said glass block edge portions in abutting relation with a surface of said respective spacer to maintain said glass blocks in spaced relation to each other, repeating steps (c) through (l) to form additional courses in said wall, and applying a filler material in the recesses formed by the adjacent glass block edges and the edge of said spacers to further stabilize the glass block wall.

* * * * *